US008646638B2

(12) United States Patent
Buskermolen et al.

(10) Patent No.: US 8,646,638 B2
(45) Date of Patent: Feb. 11, 2014

(54) FOLDABLE CONTAINER

(75) Inventors: Robert A. Buskermolen, Amsterdam (NL); Kimmo Eggers, Leamington Spa (GB); Arthur Vincent Marius Meijers, Rotterdam (NL); Gunawan Kusuma Koesdianto, Delft (NL)

(73) Assignee: Technische Universiteit Delft, Delft (NL)

( * ) Notice: Subject to any disclaimer, the term of this patent is extended or adjusted under 35 U.S.C. 154(b) by 0 days.

(21) Appl. No.: 13/336,361

(22) Filed: Dec. 23, 2011

(65) Prior Publication Data

US 2012/0160845 A1 Jun. 28, 2012

Related U.S. Application Data

(63) Continuation of application No. PCT/NL2010/050370, filed on Jun. 16, 2010.

(30) Foreign Application Priority Data

Jun. 24, 2009 (NL) ..... 2003079

(51) Int. Cl.
*B65D 6/16* (2006.01)

(52) U.S. Cl.
USPC ..... 220/6; 220/1.5; 220/4.28

(58) Field of Classification Search
USPC ..... 220/1.5, 4.28, 4.32, 6, 7
See application file for complete search history.

(56) References Cited

U.S. PATENT DOCUMENTS

| | | | | | |
|---|---|---|---|---|---|
| 844,955 | A * | 2/1907 | Morgan | 220/8 |
| 1,156,221 | A * | 10/1915 | Focks | 217/47 |
| 3,799,384 | A * | 3/1974 | Hurkamp | 220/6 |
| 4,177,907 | A * | 12/1979 | Funaioli et al. | 220/1.5 |
| 4,309,013 | A | 1/1982 | Howe | |
| 4,577,772 | A * | 3/1986 | Bigliardi | 220/1.5 |
| 4,630,746 | A * | 12/1986 | Fortenberry | 220/6 |
| 4,726,486 | A * | 2/1988 | Masuda | 220/1.5 |
| 4,848,618 | A * | 7/1989 | Yuan et al. | 220/1.5 |
| 5,509,559 | A * | 4/1996 | Okano et al. | 220/1.5 |
| 7,240,799 | B2 * | 7/2007 | Zhang | 206/600 |
| 7,882,973 | B2 * | 2/2011 | Krohn | 220/1.5 |
| 7,931,164 | B2 * | 4/2011 | Krohn | 220/7 |
| 7,984,819 | B1 * | 7/2011 | Davis | 220/4.28 |
| 2007/0108204 | A1 * | 5/2007 | Warhurst et al. | 220/6 |
| 2010/0018967 | A1 * | 1/2010 | Schrayvogel | 220/6 |
| 2010/0025397 | A1 * | 2/2010 | Krohn | 220/6 |

FOREIGN PATENT DOCUMENTS

| | | |
|---|---|---|
| DE | 10232261 | 2/2003 |
| FR | 2699513 | 6/1994 |
| GB | 503272 | 4/1939 |
| NL | 1017159 | 7/2002 |
| WO | WO-9414684 | 7/1994 |
| WO | WO2009034142 | 3/2009 |

* cited by examiner

*Primary Examiner* — Anthony Stashick
*Assistant Examiner* — Christopher McKinley
(74) *Attorney, Agent, or Firm* — Jeffrey D. Myers; Peacock Myers, P.C.

(57) ABSTRACT

Foldable container comprising a bottom plate, side plates and first hinges for connecting the side plates to the bottom plate, and a roof plate that is can be raised from the side plates, wherein the roof plate connects to opposite side plates by inter-positioned connecting rods, and wherein each connecting rod has at a first extremity a second hinge that connects to a side plate and at a second extremity opposite to said first extremity is slidably connected to said roof plate.

9 Claims, 10 Drawing Sheets

E.

F.

G.

E.

F.

G.

E.

F.

G.

E.

F.

G.

FOLDABLE CONTAINER

CROSS-REFERENCE TO RELATED APPLICATIONS

This application is a continuation application of International Patent Application Serial No. PCT/NL2010/050370, entitled "Foldable Container", filed on Jun. 16, 2010, which is a continuation of Netherlands Patent Application Serial No. 2003079, entitled "Foldable Container", filed on Jun. 24, 2009, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a foldable container comprising a bottom plate, side plates and first hinges for connecting the side plates to the bottom plate, and a roof plate that can be lifted from the side plates.

2. Description of Related Art

Such a foldable container with a raisable roof plate is known from the international application WO 2009/034142. This prior art document discloses the application of a balancing mechanism in order to assist during the conversion from the erect into the collapsed position of the container, wherein the side plates are folded down in order to eventually rest on the bottom plate, and conversely to assist also in the process of converting the container from the collapsed into the erect position when the side plates are lifted back into their upright position. According to this document the roof plate may be completely detached from the remainder of the container and this roof plate of the prior art container plays no role in the conversion of the container from the erect position into the collapsed position or vice versa. On the contrary, the roof plate of the prior art container requires separate handling making the conversion of the known container from an erect to a collapsed position, or vice versa, rather cumbersome.

FR-A-2 699 513 discloses a foldable container comprising a bottom plate, side plates and first hinges for connecting the side plates to the bottom plate, and a roof plate that is raisable from the side plates, wherein the roof plate connects to opposite side plates by inter-positioned connecting rods, wherein each connecting rod has at a first extremity a second hinge that connects to a side plate and at a second extremity opposite to said first extremity is connected to a carriage that is slidably mounted on the roof plate.

BRIEF SUMMARY OF THE INVENTION

It is an object of the invention to further develop this known foldable container in that it's conversion from the erect position into the collapsed position, or vice versa is simplified.

These and other objects of the invention which will become apparent from the following disclosure are realized by embodying the foldable container of the invention in accordance with one or more of the appended claims.

BRIEF DESCRIPTION OF THE SEVERAL VIEWS OF THE DRAWINGS

The invention will hereinafter be further elucidated with reference to the drawing, which shows in:

FIGS. 1A, 1B-5A, 5B several embodiments of the foldable container in accordance with the invention.

Wherever in the figures the same reference numerals are applied these numerals refer to the same parts.

DETAILED DESCRIPTION OF THE INVENTION

Figure 1A:
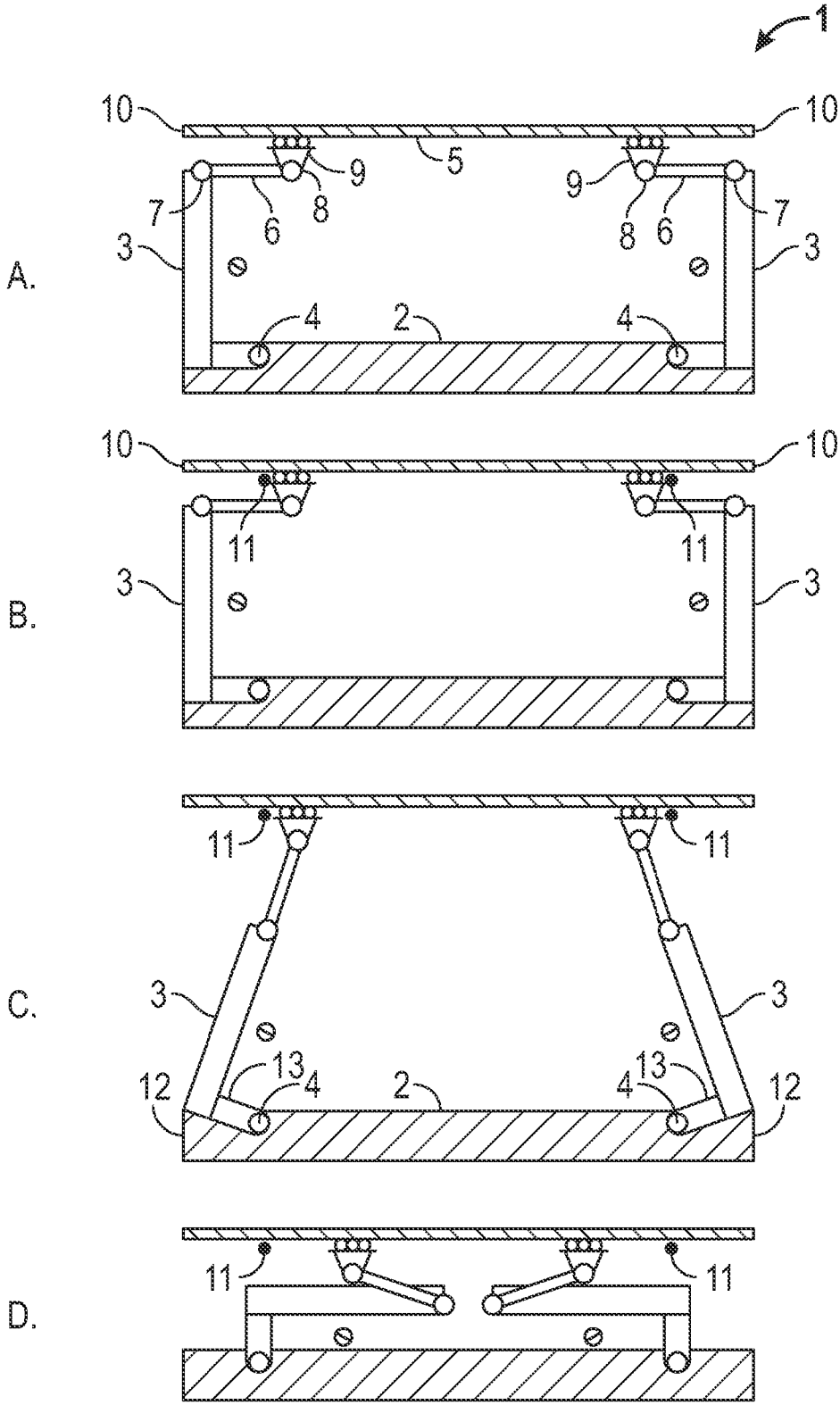

The foldable container of the invention has the feature that the carriage or carriages that are provided on the roof plate have an adjustable sliding range for arranging that the carriage or carriages can be provided with a limited excursion so as to cause that said carriage or carriages can be prevented from assuming a position at or near the roof plate's edges. This feature is particularly helpful when the container is converted from the erect to the collapsed position and circumvents that during this conversion there would be a need to manipulate any other part of the container than the roof plate.

Effectively for this purpose the container is preferably arranged such that the sliding range of the carriage or carriages is provided with a removable blocking organ. Suitably the removable blocking organ is a locking pin.

With the foldable container of the invention at all times the parts of the container remain together. Further the conversion of the foldable container from the erect to the collapsed position or vice versa can be executed by appropriate manipulation of the roof plate only, without need to disconnect the parts that make up the complete container.

A suitable embodiment of the container is that each connecting rod is provided with a hinge at its second extremity that connects said rod to the slidable carriage mounted on the roof plate.

The said carriage that provides the slidable connection with the roof plate allows that the applied connecting rods can both assume a position that corresponds with the erect position of the container as well as a position that corresponds to the collapsed position of the container. To this end the container of the invention preferably comprises the feature that the carriage or carriages have a sliding range that extends from an edge of the roof plate inwards to a point that allows that the connecting rod or rods that are connected to said carriage or carriages, assume a position substantially parallel to the roof plate when such roof plate is in a position that corresponds to the ready-to-use erect position of the container.

A feature that particularly assists when the foldable container is converted from the collapsed into the erect position is that the carriages have preferential positions at or near the edges of the roof plate. The benefit of this feature will become clear from the discussion of the appended exemplary embodiments.

There are several embodiments feasible in order to arrange that the carriages have preferential positions at or near the edges of the roof plate. A first embodiment has the feature that the roof plate has carriages that are mounted on rails that slope downwardly towards the edges of the roof plate. A second embodiment has the feature that the carriages are spring-loaded so as to urge said carriages towards the edges of the roof plate. It is also possible to combine the features of the first embodiment and the second embodiment.

Preferably the first hinges for connecting the side plates to the bottom plate are provided at a predetermined distance from the bottom plate edges. By this feature the final stages of converting the container to the collapsed or to the erect position benefit from and are assisted by the forces of gravity. This can be further promoted by arranging that the side plates are provided with inwardly projecting arms wherein the first hinges are provided at extremities of said arms connecting the side plates to the bottom plate.

Figure 1B:
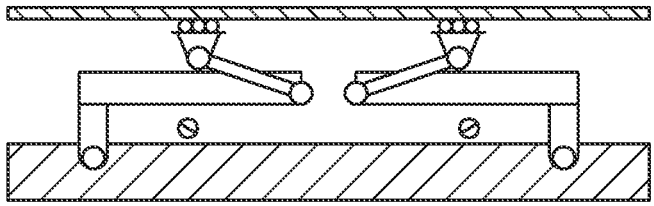
Figure 1B:
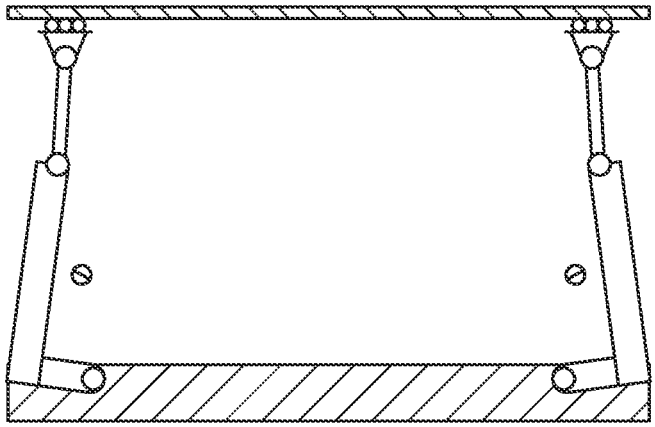
Figure 1B:
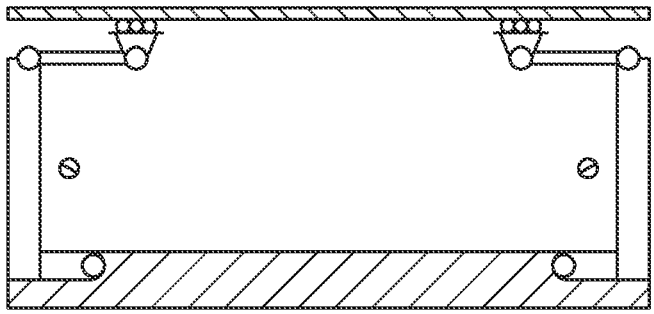

Each of the figures shows a particular embodiment of the foldable container of the invention, notably FIGS. 1A and 1B relate to an embodiment without means to urge the carriages of the roof plate to preferential positions at or near the edges of the roof plate, and FIGS. 2A, 2B-5A, 5B relate to several embodiments in which such means are present. All FIGS. 1A, 1B-5A, 5B show a series of steps a-g pertaining to the conversion of a foldable container from the erect position to the collapsed position, and back to the erect position.

In all figures the container is shown only schematically.

With reference now first to FIGS. 1A and 1B the shown container 1 comprises a bottom plate 2, side plates 3 and first hinges 4 for connecting the side plates 3 to the bottom plate 2. Further the roof plate 5 can be moved away by lifting it up from the side plates 3 as the figures clearly show.

FIGS. 1A and 1B further show that the roof plate 5 connects to two opposite side plates 3 by inter-positioned connecting rods 6, wherein each connecting rod 6 has at a first extremity a second hinge 7 that connects to a side plate 3 and at a second extremity opposite to the first extremity a slidable connection with the roof plate 5. This is embodied such that each connecting rod 6 is provided with a third hinge 8 at its second extremity that connects that rod 6 to a carriage 9 that is mounted on the roof plate 5.

As just mentioned the roof plate 5 is provided with carriages 9, and these carriages 9 have a sliding range that basically extends from an edge 10 of the roof plate 5 inwards to a point that allows that the connecting rods 6 that are connected to said carriages 9 are able to assume a position substantially parallel to the roof plate 5, when said roof plate 5 is close to the side plates 3 in a position that nearly corresponds to the ready-to-use erect position of the container. This can be understood from what the respective figures show at step a. The carriage or carriages 9 that are provided on the roof plate 5 have an adjustable sliding range for arranging that the carriage or carriages 9 can be provided with a limited excursion so as to cause that said carriage or carriages can be prevented from assuming a position at or near the roof plate's edges 10. For this purpose preferably the sliding range of the carriage or carriages 9 is provided with a removable blocking organ 11, such as for instance a locking pin 11.

The just mentioned limited excursion of the sliding range of the carriages 9, for instance by applying said locking pin 11 causes that the carriages 9 are prevented from assuming a position at or near the roof plate's edges 10. This is shown at step b of the respective figures, and its effect is clear from the subsequent step c in the respective figures, showing the lifting of the roof plate 5 and the consequential inwards movement of the side plates 3.

The figures further clearly show that the side plates 3 have first hinges 4 that connect the side plates 3 to the bottom plate 2 at a predetermined distance from the bottom plate's edges 12. This is embodied such that the side plates 3 have inwardly projecting arms 13, whereby the first hinges 4 are provided at the extremities of said arms 13 connecting the side plates 3 to the bottom plate 2. In combination with the limitation of the carriage movement by the blocking organ, such as said locking pin 11 that causes the side walls 3 to swivel when the roof plate is lifted, this very much assists to arrange that the center of gravity of the swiveling side walls 3 is moved inwardly beyond the first hinges 4, and let gravity assist in further moving the side walls 3 to the collapsed position shown in step d of the respective figures.

When the container 1 is in the collapsed position as shown at step d, and should be returned to the erect position, then first the blocking organ, such as the locking pin 11 that limits the movement of the carriages 9 should be removed. After removal of the blocking organ 11 the carriages 9 are free to run along their entire sliding range and assume a position near to the edges 10 of the roof plate 5. When the roof plate 5 is initially lifted as is shown at step e of the respective figures, the carriages 9 move towards said edges 10 of the roof plate 5- as shown at step f- causing that eventually also the side walls 3 are lifted to an upright position by the force transferred to the side walls 3 through the connecting rods 6. When arrived at the position shown at step f in the figures, the center of gravity of the sidewalls 3 has moved outwardly beyond the hinges 4, and arranges now that gravity helps to bring back the sidewalls 3 to the fully upright position as shown at step g in FIGS. 1B, 2B, 3B, 4B and 5B.

Particularly for assisting the movement of the carriages 9 to their preferential position at or near the roof plate's edges 10, FIGS. 2A, 2B-5A, 5B show embodiments of the container 1 with means for urging the carriages 9 to said edges 10.

Figure 2A:
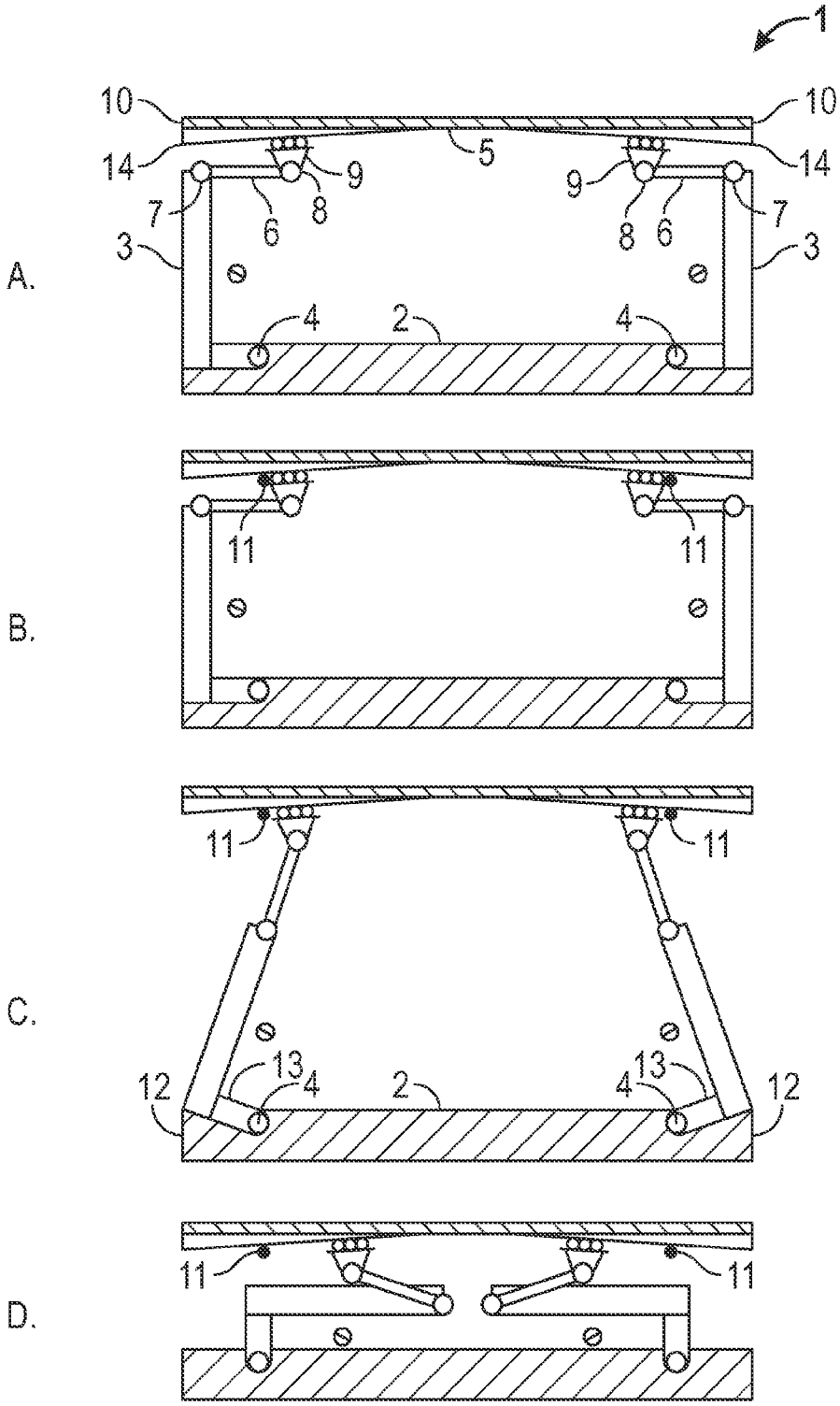
Figure 2B:
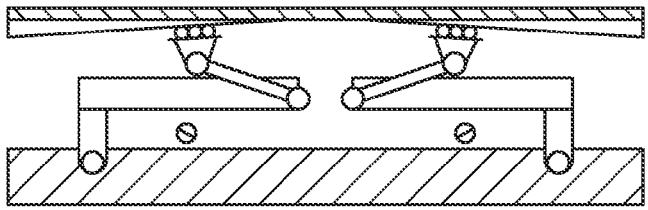
Figure 2B:
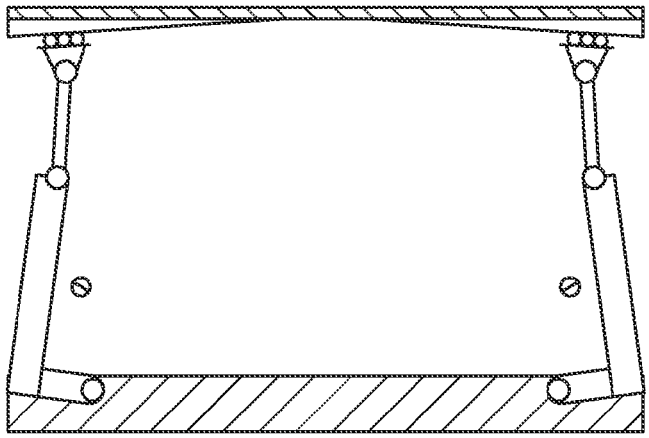
Figure 2B:
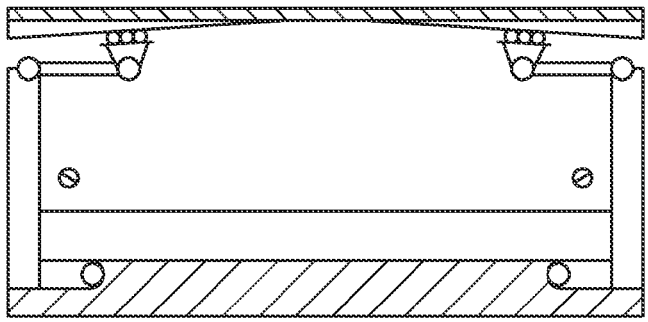

In FIG. 2A and 2B an embodiment of the container 1 is shown wherein the carriages 9 are mounted on rails 14 that slope downwardly towards the edges 10 of the roof plate 5.

Figure 3A:
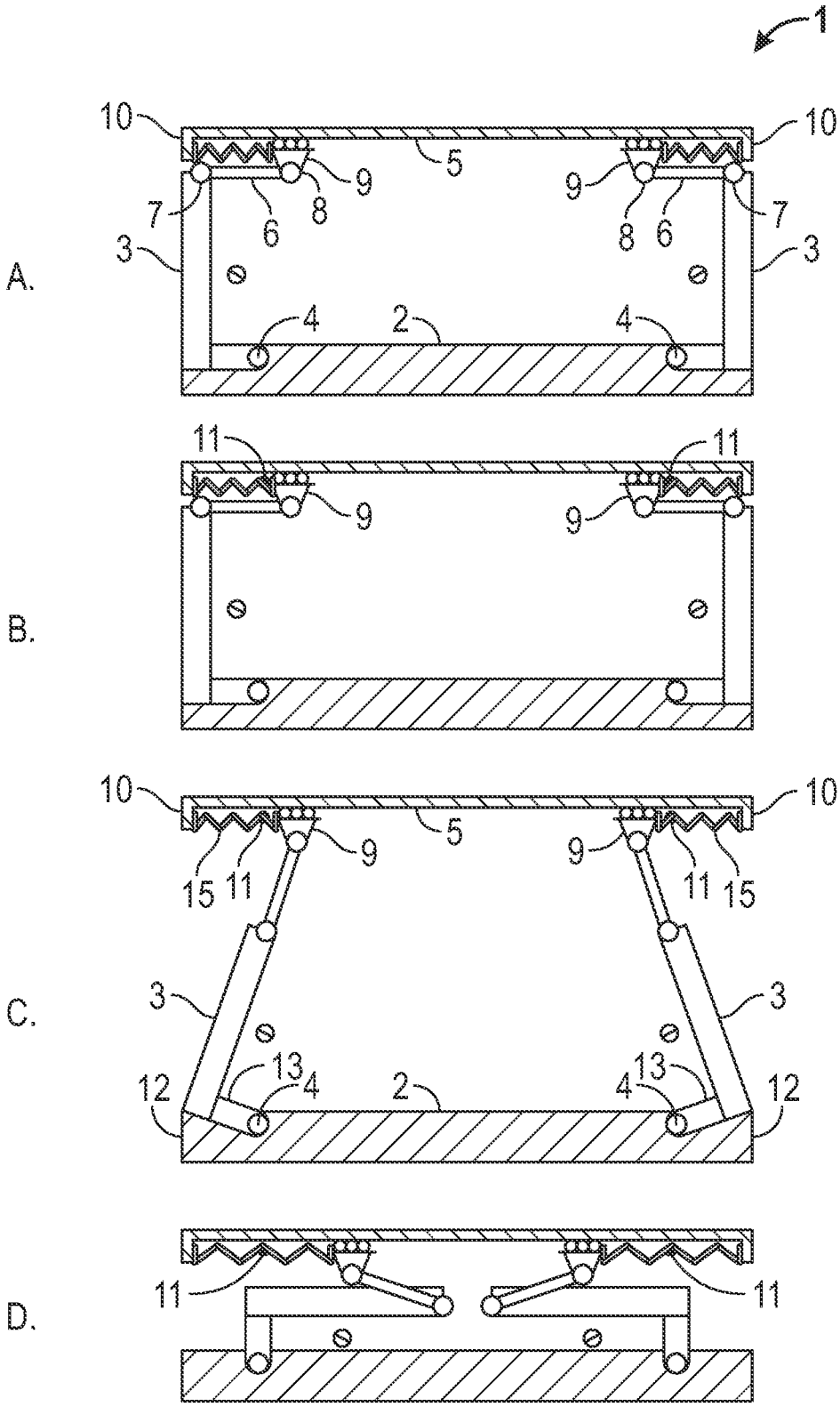
Figure 3B:
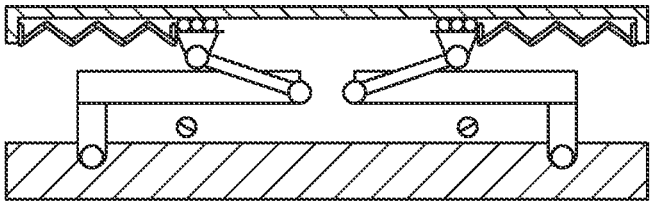
Figure 3B:
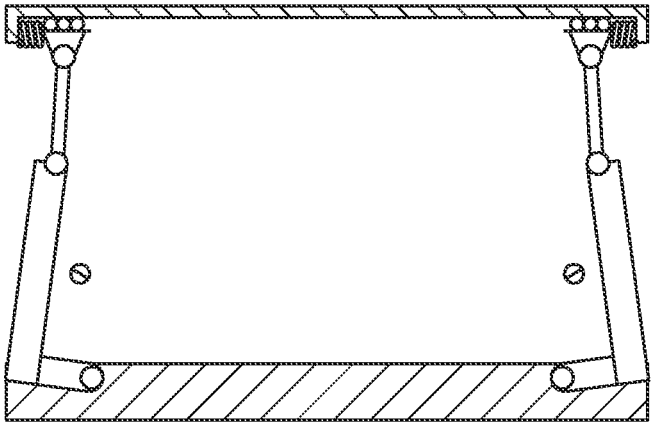
Figure 3B:
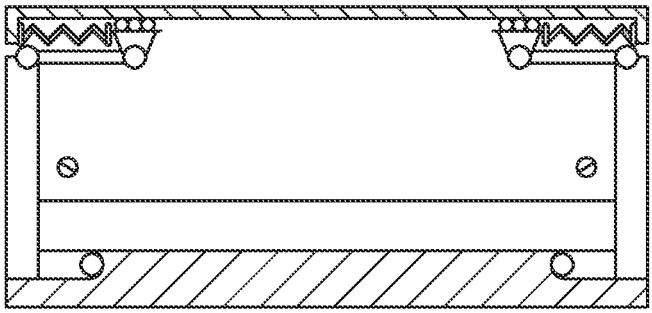
Figure 4A:
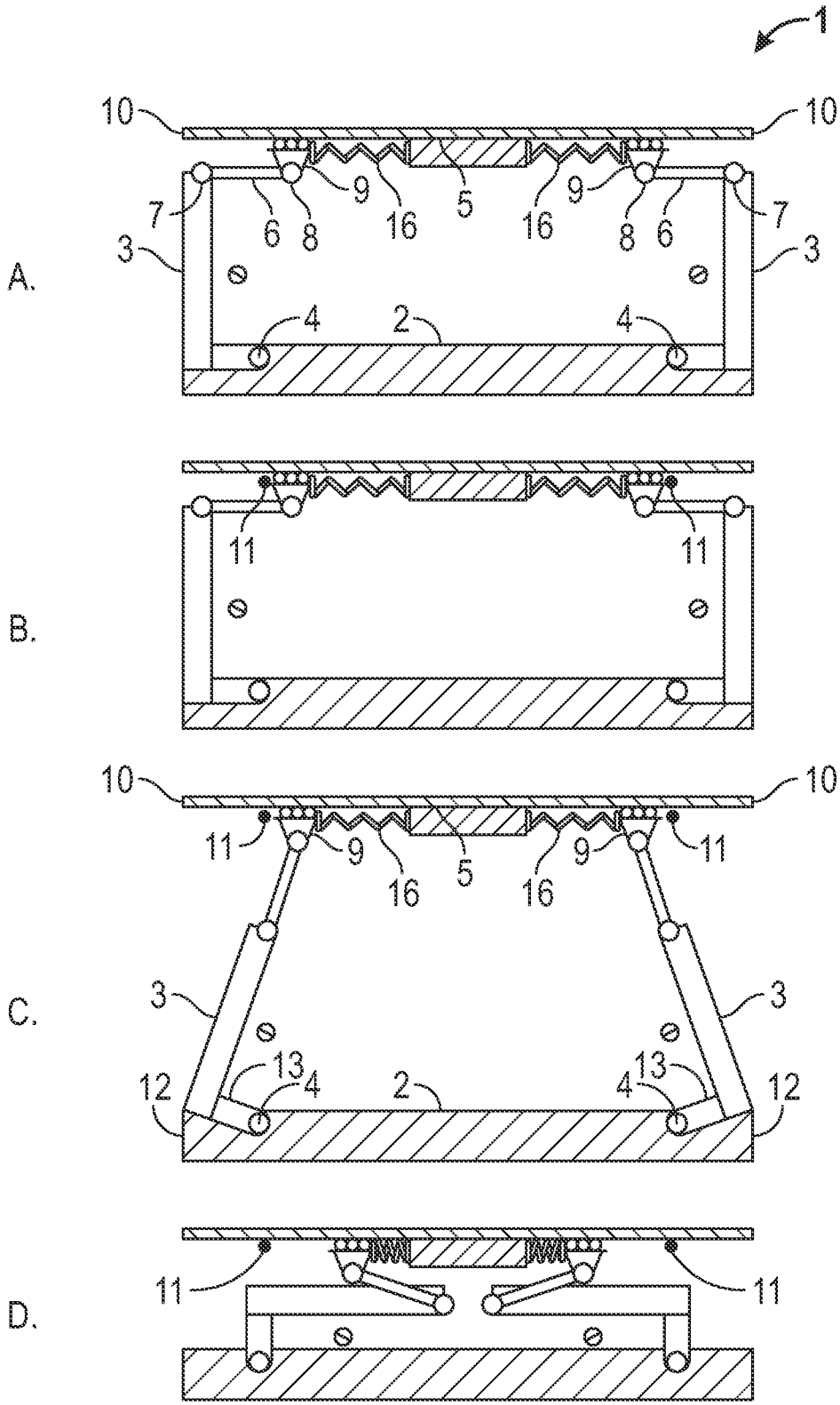
Figure 4B:
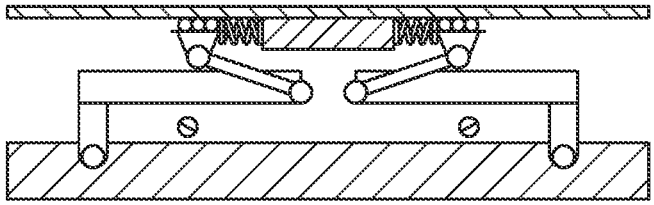
Figure 4B:
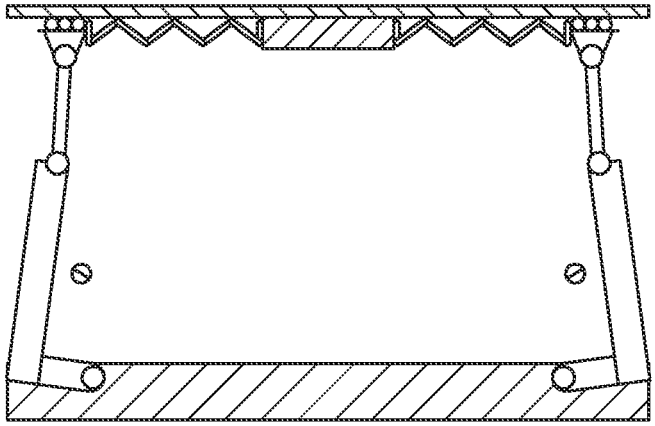
Figure 4B:
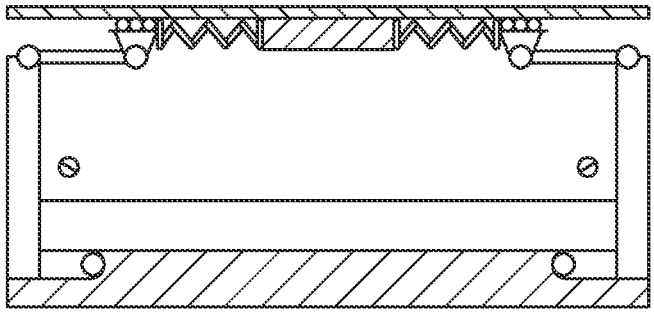
Figure 5A:
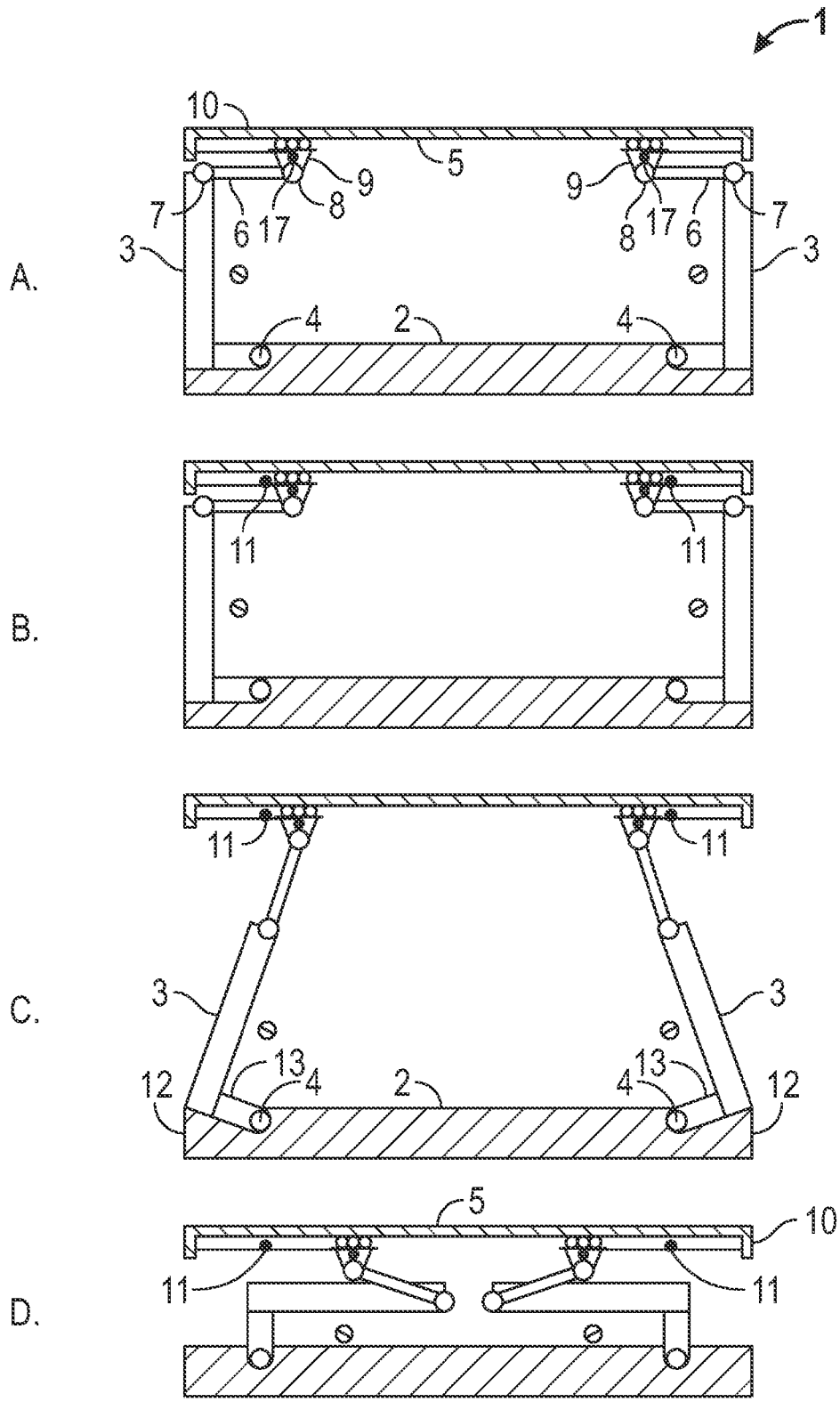
Figure 5B:
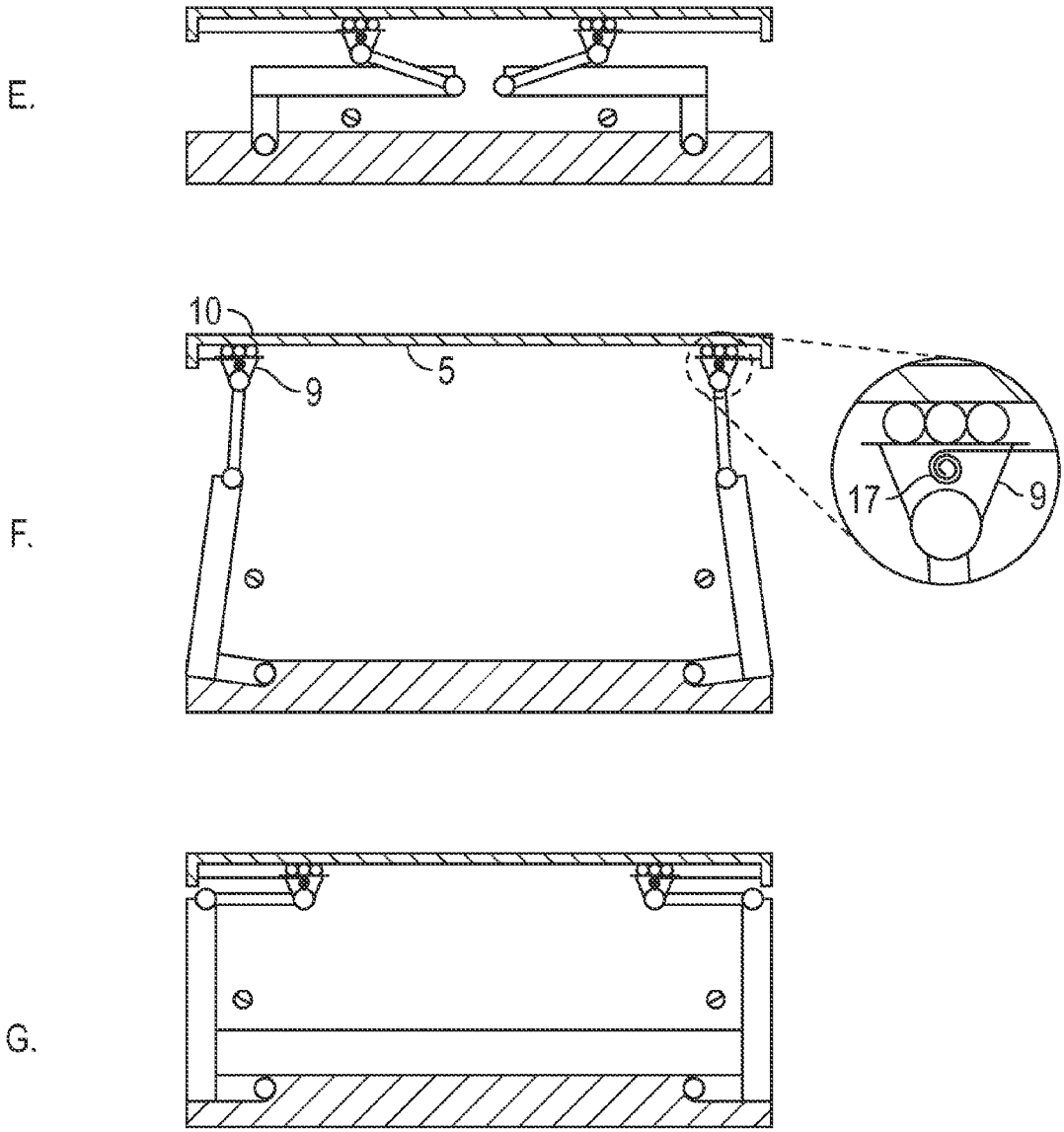

In FIG. 3A and 3B, FIG. 4A and 4B, and FIG. 5A and 5B embodiments of the container 1 are shown wherein the carriages are spring-loaded. FIGS. 3A and 3B show the embodiment in which tension springs 15 are applied; FIGS. 4A and 4B show the embodiment in which compression springs 16 are applied; and FIGS. 5A and 5B show the embodiment wherein a constant force spring 17 is applied. In all embodiments the springs 15, 16, 17 urge the carriages 9 towards the preferential position at or near the edges 10 of the roof plate 5.

In FIG. 3, FIG. 4 and FIG. 5 embodiments of the container 1 are shown wherein the carriages are spring-loaded. FIG. 3 shows the embodiment in which tension springs 15 are applied; FIG. 4 shows the embodiment in which compression springs 16 are applied; and FIG. 5 shows the embodiment wherein a constant force spring 17 is applied. In all embodiments the springs 15, 16, 17 urge the carriages 9 towards the preferential position at or near the edges 10 of the roof plate 5.

Although in the above several preferred embodiments of the container of the invention are discussed, the protective scope of the appended claims is not limited to these embodiments. The discussed embodiments only serve to elucidate the features of the claims, however the protective scope that pertains to these claims should be understood in that numerous variations are possible to the disclosed embodiments without departing from the gist of the invention as embodied in the appended claims.

What is claimed:

1. Foldable container comprising a bottom plate, side plates and first hinges for connecting the side plates to the bottom plate, and a roof plate that is raisable from the side plates, wherein the roof plate connects to opposite side plates by inter-positioned connecting rods, wherein each connecting rod has at a first extremity a second hinge that connects to a side plate and at a second extremity opposite to said first extremity is connected to a carriage that is slidably mounted on the roof plate, and wherein the carriage or carriages that are provided on the roof plate have an adjustable sliding range for arranging that the carriage or carriages can be provided with a limited excursion so as to cause that said carriage or carriages can be prevented from assuming a position at or near the roof plate's edges.

2. Container according to claim 1, wherein the sliding range of the carriage or carriages is provided with a removable blocking organ.

3. Container according to claim 2, wherein the removable blocking organ is a locking pin.

4. Container according to claim 1, wherein each connecting rod is provided with a third hinge at its second extremity that connects said rod to the carriage that is slidably mounted on the roof plate.

5. Container according to claim 1, wherein the carriage or carriages have sliding range that extends from an edge of the roof plate inwards to a point that allows the connecting rod or rods that are connected to said carriage or carriages to assume a position substantially parallel to the roof plate when such roof plate is close to the side plates in a position that nearly corresponds to a ready-to-use erect position of the container.

6. Container according to claim 5, wherein the carriage or carriages have preferential positions at or near the edges of the roof plate.

7. Container according to claim 1, wherein the roof plate has carriages that are mounted on rails that slope downwardly towards the edges of the roof plate.

8. Container according to claim 1, wherein the first hinges for connecting the side plates to the bottom plate are provided at a predetermined distance from the bottom plate edges.

9. Container according to claim 8, wherein the slide plates are provided with inwardly projecting arms wherein the first hinges are provided at extremities of said arms connecting the side plates to the bottom plate.

* * * * *